US006204835B1

(12) United States Patent
Yang et al.

(10) Patent No.: US 6,204,835 B1
(45) Date of Patent: Mar. 20, 2001

(54) CUMULATIVE TWO PHASE DRIVE SCHEME FOR BISTABLE CHOLESTERIC REFLECTIVE DISPLAYS

(75) Inventors: Deng-Ke Yang, Hudson; Yang-Ming Zhu, Kent, both of OH (US)

(73) Assignee: Kent State University, Kent, OH (US)

( * ) Notice: Subject to any disclaimer, the term of this patent is extended or adjusted under 35 U.S.C. 154(b) by 0 days.

(21) Appl. No.: 09/076,564

(22) Filed: May 12, 1998

(51) Int. Cl.[7] ..... G09G 3/36; G09G 5/00

(52) U.S. Cl. ..... 345/94; 345/87; 345/90; 345/208

(58) Field of Search ..... 345/87, 90, 94, 345/208

(56) References Cited

U.S. PATENT DOCUMENTS

| | | | |
|---|---|---|---|
| 4,317,115 | 2/1982 | Kawakami et al. | 359/55 |
| 4,514,045 | 4/1985 | Huffman et al. . | |
| 4,626,074 | 12/1986 | Crossland et al. . | |
| 4,636,788 | 1/1987 | Hilbrink . | |
| 4,641,135 | 2/1987 | Canter et al. . | |
| 4,705,345 | 11/1987 | Ayliffe et al. . | |
| 4,728,175 | 3/1988 | Baron . | |
| 4,761,058 | 8/1988 | Okubo et al. . | |
| 4,769,639 | 9/1988 | Kawamura et al. . | |
| 4,864,538 | 9/1989 | Buzak . | |
| 4,909,607 | 3/1990 | Ross . | |
| 4,958,915 | 9/1990 | Okada et al. . | |
| 5,036,317 | 7/1991 | Buzak . | |
| 5,132,823 | 7/1992 | Kamath et al. . | |
| 5,168,378 | 12/1992 | Black et al. . | |
| 5,168,380 | 12/1992 | Fergason . | |
| 5,189,535 | 2/1993 | Mochizuki et al. | 359/55 |
| 5,251,048 | 10/1993 | Doane et al. . | |
| 5,252,954 | 10/1993 | Nagata et al. | 345/210 |
| 5,260,699 | 11/1993 | Lister et al. . | |
| 5,280,280 | 1/1994 | Hotto . | |
| 5,285,214 | 2/1994 | Bowry . | |
| 5,289,175 | 2/1994 | Kawagishi | 359/84 |
| 5,289,300 | 2/1994 | Yamazaki et al. . | |
| 5,293,261 | 3/1994 | Shashidhar et al. . | |
| 5,315,101 | 5/1994 | Hughes et al. . | |
| 5,661,533 * | 8/1997 | Wu et al. | 349/169 |
| 5,748,277 * | 5/1998 | Huang et al. | 349/169 |
| 5,933,203 * | 8/1999 | Wu et al. | 345/208 |

FOREIGN PATENT DOCUMENTS

| | | |
|---|---|---|
| 0 337 780 A1 | 10/1989 | (EP) . |
| 0 523 558 A1 | 1/1993 | (EP) . |
| WO 98/55987 | 12/1998 | (WO) . |

OTHER PUBLICATIONS

Kozachenko et al., *Hysteresis as a Key Factor for the Fast Control of Reflectivity in Cholesteric LCDs,* 1997 SID, pp. 148–151.

* cited by examiner

*Primary Examiner*—Richard A. Hjerpe
*Assistant Examiner*—Duc Dinh
(74) *Attorney, Agent, or Firm*—Renner, Kenner, Greive, Bobak, Taylor & Weber

(57) ABSTRACT

Bistable cholesteric liquid crystal material is disposed between opposed substrates, wherein one of the substrates has a first plurality of electrodes facing a second plurality of electrodes on the other substrate, wherein the intersection of the first and the second plurality of electrodes forms a plurality of pixels. The material is addressed by applying a preparation voltage across the first and second plurality of electrodes and then subsequently applying a selection voltage across the first and second plurality of electrodes. The material is then allowed to relax for a period of time, whereupon the preparation and selection voltages are reapplied. These steps are repeated until the liquid crystal material obtains the desired reflectance.

15 Claims, 4 Drawing Sheets

CUMULATIVE TWO PHASE DRIVE SCHEME FOR BISTABLE CHOLESTERIC REFLECTIVE DISPLAYS

GOVERNMENT RIGHTS

The United States Government has a paid-up license in this invention and may have the right in limited circumstances to require the patent owner to license others on reasonable terms as provided for by the terms of Contract No. N61331-94-K-0042, awarded by the Defense Advanced Research Projects Agency.

TECHNICAL FIELD

The present invention relates generally to drive schemes for liquid crystal displays employing cholesteric, reflective bistable liquid crystal material. In particular, the present invention relates to a drive scheme for cholesteric liquid crystal material that drives the liquid crystal material between a reflective planar texture and a non-reflective focal conic texture. Specifically, the present invention is directed to a drive scheme which repeatedly applies a series of two pulses with a relaxation time between each series so as to incrementally change the appearance of the liquid crystal material.

BACKGROUND ART

Drive schemes for cholesteric materials are disclosed in U.S. patent application Ser. No. 08/852,319, which is incorporated herein by reference. As discussed therein, a two phase drive scheme may be employed to completely drive the cholesteric liquid crystal material from one texture to another. This drive scheme, although simple in application requires the use of relatively long duration pulses with a large magnitude for the preparation and selection phases. As a result, use of the disclosed two phase drive scheme generates a flicker when operative at a video rate frequency. Moreover, the disclosed two phase drive scheme requires high voltage application and therefore costlier drive circuits.

Based upon the foregoing, it is evident that there is a need in the art for a drive scheme which is simple yet employs lower voltage values to attain the desired texture. Moreover, there is a need in the art for a simple two phase drive scheme which is suitable for video rate operation.

DISCLOSURE OF INVENTION

In light of the foregoing, it is a first aspect of the present invention to provide a cumulative two phase drive scheme for a bistable cholesteric reflective display.

Another aspect of the present invention is to provide a cholesteric liquid crystal display cell with opposed substrates, wherein one of the substrates has a plurality of row electrodes facing the other substrate which has a plurality of column electrodes, and wherein the intersections between the row and column electrodes form picture elements or pixels.

Yet another aspect of the present invention, as set forth above, is to provide a cumulative two phase drive scheme which repeats a series of two voltage applications to incrementally change the texture of the liquid crystal material between focal conic and planar textures as well as change the reflectance of the cholesteric material.

A further aspect ofthe present invention, as set forth above, is to provide a cumulative two phase drive scheme wherein a first phase of the series applies a preparation voltage and a second phase of the series applies a selection voltage, whereupon the material is allowed to relax and then the two phases are reapplied to the liquid crystal material.

Yet a further aspect of the present invention, as set forth above, is to apply a high selection voltage to the liquid crystal material which causes an incremental change in the appearance thereof and wherein repeated applications of the high selection voltage drives the material toward a planar texture.

Yet an additional aspect of the present invention, as set forth above, is to apply a low selection voltage to the liquid crystal material which causes an incremental change in the appearance thereof and wherein repeated applications of a low selection voltage drives the material toward a focal conic texture.

The foregoing and other aspects ofthe present invention which shall become apparent as the detailed description proceeds are achieved by a method of addressing bistable liquid crystal material disposed between opposed substrates, and wherein one of the substrates has a first plurality of electrodes facing a second plurality of electrodes on the other substrate, wherein the intersection of the first and the second plurality of electrodes forms a plurality of pixels, the method comprising the steps of: a) applying a preparation voltage across the first and second plurality of electrodes; b) subsequently applying a selection voltage across the first and second plurality of electrodes; and c) repeating steps a) and b) until the material exhibits a desired reflectance.

Other aspects of the present invention are obtained by a method of addressing a cell of bistable cholesteric liquid crystal material disposed between opposed substrates, wherein one of the substrates has a plurality of row electrodes facing a plurality of column electrodes on the other substrate, and wherein intersections of the row and the column electrodes form a plurality of pixels on the cell, the method comprising the steps of: applying a preparation voltage to one of said row electrodes and said column electrodes; applying a portion of said selection voltage to one of said row electrodes and said column electrodes while applying a remaining portion of the selection voltage to the other of said row electrodes and said column electrodes; allowing the material to relax; and repeating said applying and said allowing steps until the material is driven to a desired texture.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
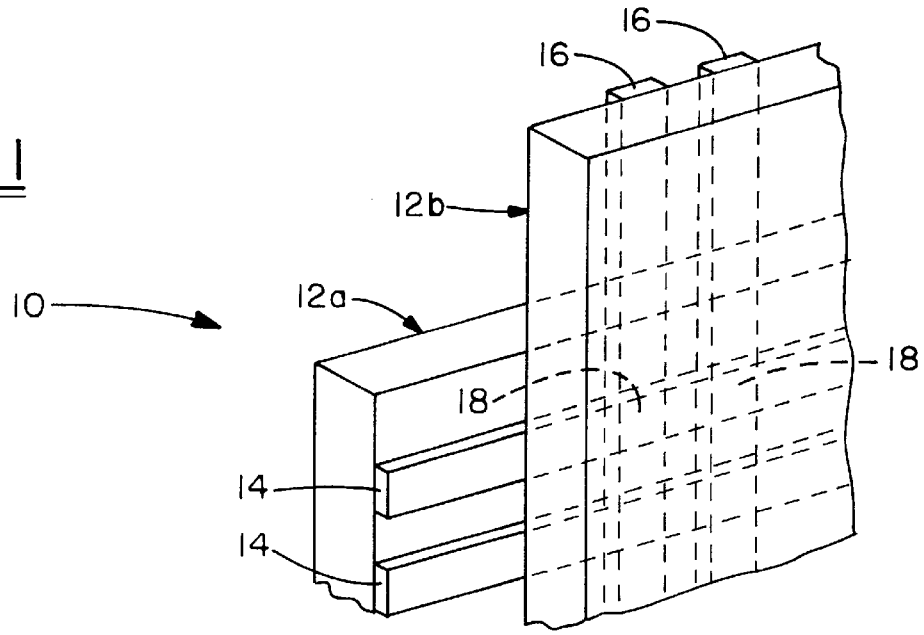
FIG. 1 is a perspective schematic representation of a liquid crystal display using row and column electrodes.

Referring now to the drawings and in particular to FIG. 1, it can be seen that a liquid crystal display, according to the present invention is designated generally by the numeral 10. The display 10 includes opposed substrates 12*a* and 12*b* which may be either glass or plastic materials that are optically clear in appearance. In the preferred embodiment, a bistable cholesteric liquid crystal material is disposed between the opposed substrates 12 in a manner well-known in the art. One of the opposed substrates 12*a* includes a plurality of row electrodes 14 facing the opposite substrate 12*b*. Likewise, the other opposed substrate 12*b* provides a plurality of column electrodes 16 which face the opposed substrate 12*a*. By orthogonally orienting the electrodes 14 and 16, a plurality of picture elements or pixels 18 are formed at the intersections thereof across the entire surface of the liquid crystal display 10. Each of the pixels 18 may be individually addressed so as to generate indicia on the liquid crystal display 10. As will become apparent from the following description, each row electrode 14 and column electrode 16 is addressed by processor controlled electronics (not shown) to a range of voltage values that drive the cholesteric liquid crystal material to a desired reflectance or appearance.

Figure 2:
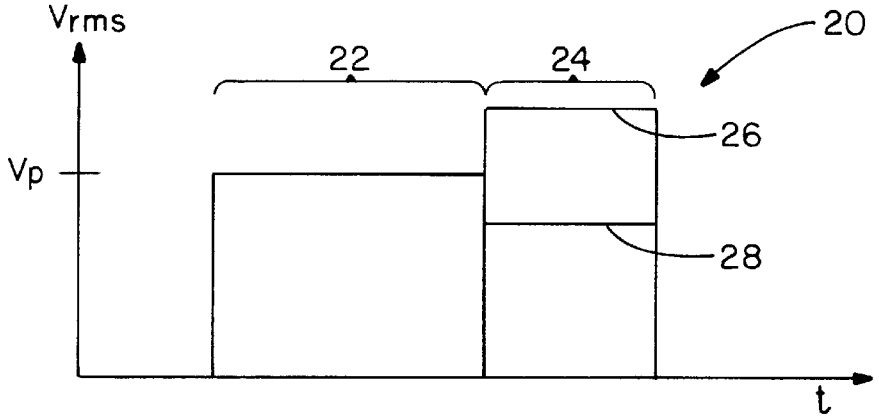
FIG. 2 is a graphical representation of a two phase drive scheme.

Referring now to FIG. 2, a two phase drive scheme or "kick" used in the present invention is designated generally by the numeral 20. The drive scheme 20 includes a preparation phase 22 and a selection phase 24. The preparation phase 22 includes application of a preparation voltage $V_p$. The selection phase 24 consists of application of one of two voltage values. One voltage value is $V_{high}$ 26 and the other value is $V_{low}$ 28. Although $V_{high}$ 26 is shown to be greater than $V_p$, and $V_{low}$ 28 is shown to be less than $V_p$,it will be appreciated that both $V_{high}$ and $V_{low}$ could be greater than or less than $V_p$. Selection of $V_P$, $V_{high}$ and $V_{low}$ is dependent upon the type of cholesteric liquid crystal material and upon the duration of the selection phase 24. Depending upon the present texture of the material—the texture of the material prior to application of $V_p$—the selection voltage values may be considered as a driving voltage or a holding voltage as will become apparent. Regardless of the present texture of the cholesteric liquid crystal material, the preparation phase 22 partially drives the cholesteric material toward the focal conic texture. In the selection phase 24 if the voltage is $V_{high}$ 26, then the material remains at or is partially switched to the homeotropic texture, afterwards, this portion of the material relaxes to the planar texture. If, however, the applied voltage is $V_{low}$ 28, the material remains at or it switches to the focal conic texture.

Figure 3A:
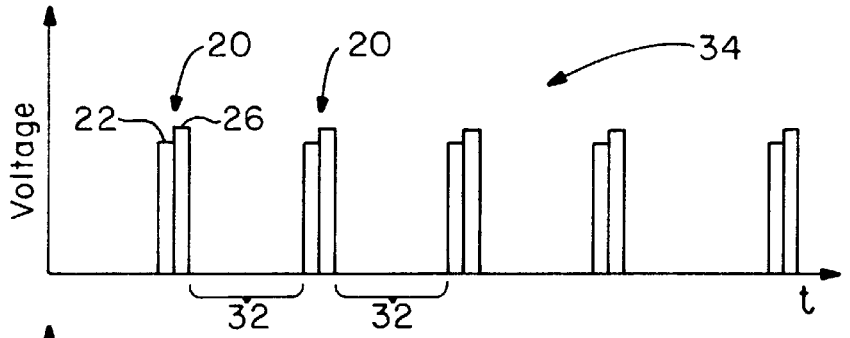
FIGS. 3A–B show a schematic representation of a cumulative two phase drive scheme showing application of a preparation voltage and a driving selection voltage along with a relaxation time which results in an incremental increase in reflectance of the cholesteric liquid crystal material.
Figure 3B:
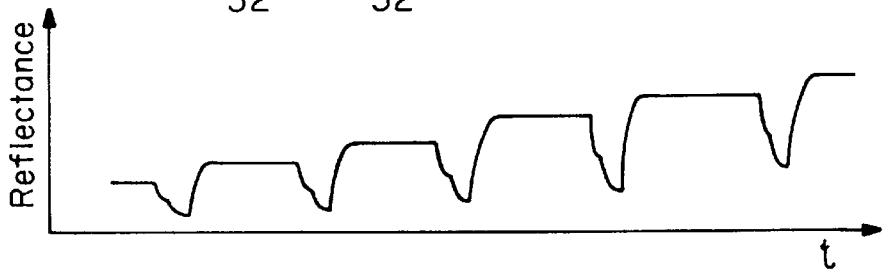
Figure 4A:
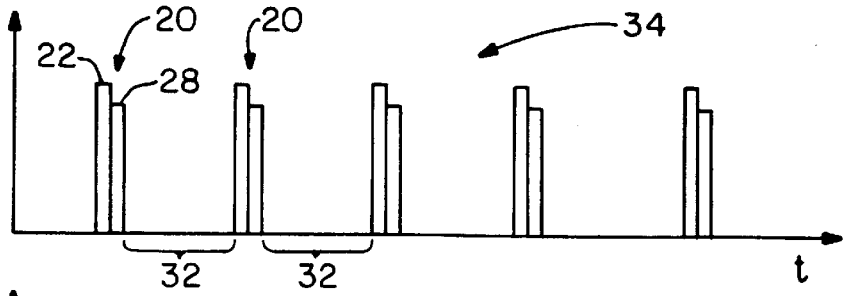
FIGS. 4A–B show a schematic representation of a cumulative two phase drive scheme showing application of a preparation voltage and a holding selection voltage along with a relaxation time which results in maintaining the reflectance of the cholesteric liquid crystal material.
Figure 4B:
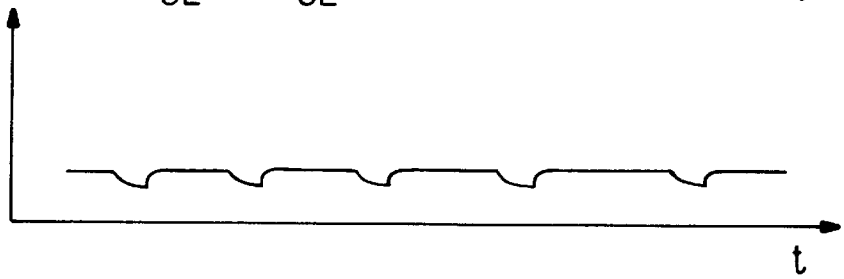

As seen in FIGS. 3A and 3B, the liquid crystal material is disposed in the focal conic texture as evidenced by the initial low reflectance appearance. As noted above, the preparation voltage $V_p$ is then applied to partially drive the material further into the focal conic texture. Next, during the selection phase 24, if $V_{high}$ is applied, the material is partially switched to the homeotropic texture. When the selection phase ends and the selection voltage is removed, a relaxation time 32 commences during which a portion of the material relaxes to the planar texture. As such, the reflectance of the material is incrementally increased. If during the selection phase $V_{low}$ is applied and the material is in the focal conic texture, as seen in FIGS. 4A and 4B, the material is held at or relaxes to the focal conic texture. Accordingly, during the relaxation phase 32, the material remains in the focal conic texture. Thus, it will be appreciated that repeated applications of the drive scheme 20 and the relaxation phase 32 provide a cumulative two phase drive scheme designated generally by the numeral 34. As seen in FIGS. 3A–B and 4A–B, the drive scheme 34 can be used to incrementally drive the cholesteric liquid crystal material from the focal conic texture toward the planar texture or maintain the material in the focal conic texture.

Figure 5A:
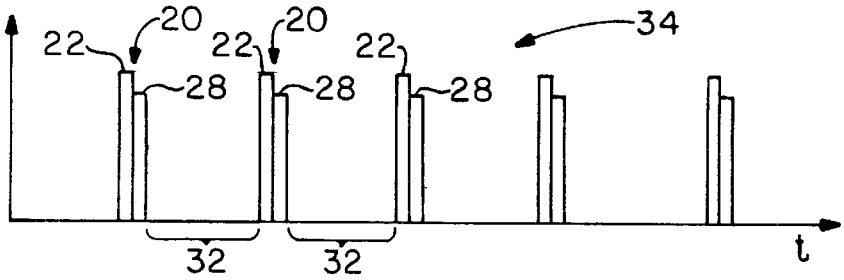
FIGS. 5A–B show a schematic representation of a cumulative two phase drive scheme showing application of a preparation voltage and a driving selection voltage along with a relaxation time which results in an incremental decrease in reflectance of the cholesteric liquid crystal material.
Figure 5B:
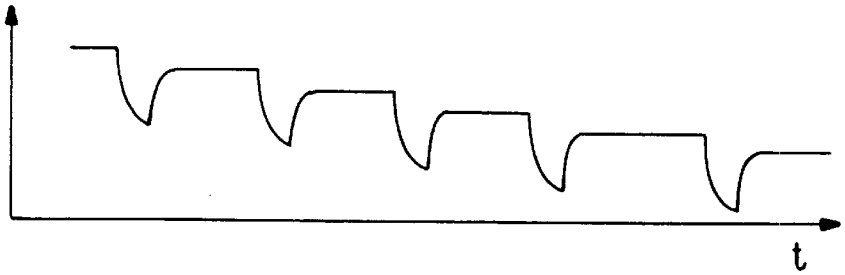
Figure 6A:
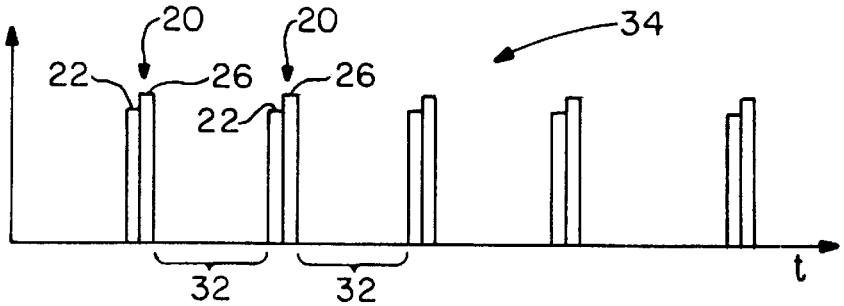
FIGS. 6A–B show a schematic representation of a cumulative two phase drive scheme showing application of a preparation voltage and a holding selection voltage along with a relaxation time which results in maintaining the reflectance of the cholesteric liquid crystal material.
Figure 6B:
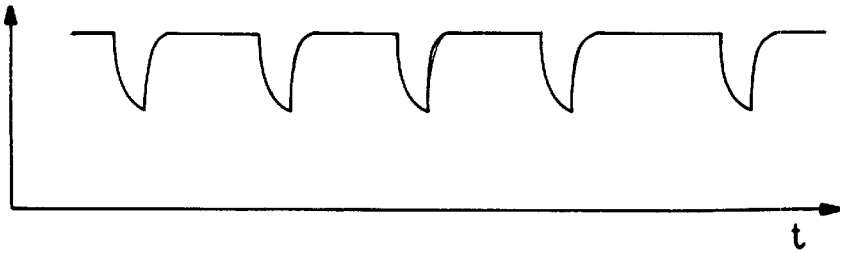

A similar sequence of events occurs when the material is in the planar texture, which exhibits a high reflectance, as seen in FIGS. 5A and 5B. As before, application of the preparation voltage during the preparation phase 22 partially drives the material toward the focal conic texture. If during the selection phase $V_{low}$ 28 is applied, the material remains at or relaxes to the focal conic texture. During the relaxation phase 32, a portion of the material remains in the focal conic texture and the reflectance of the material incrementally decreases. If during the selection phase $V_{high}$ 26 is applied and the material is in the planar texture, as seen in FIGS. 6A and 6B, the material is partially switched to the homeotropic texture. During the relaxation phase 32 the material then reverts to the planar texture. Thus, it can be seen that the drive scheme 34 may also be used to incrementally drive the material from the planar texture toward the focal conic texture or maintain the material in the planar texture.

Figure 7:
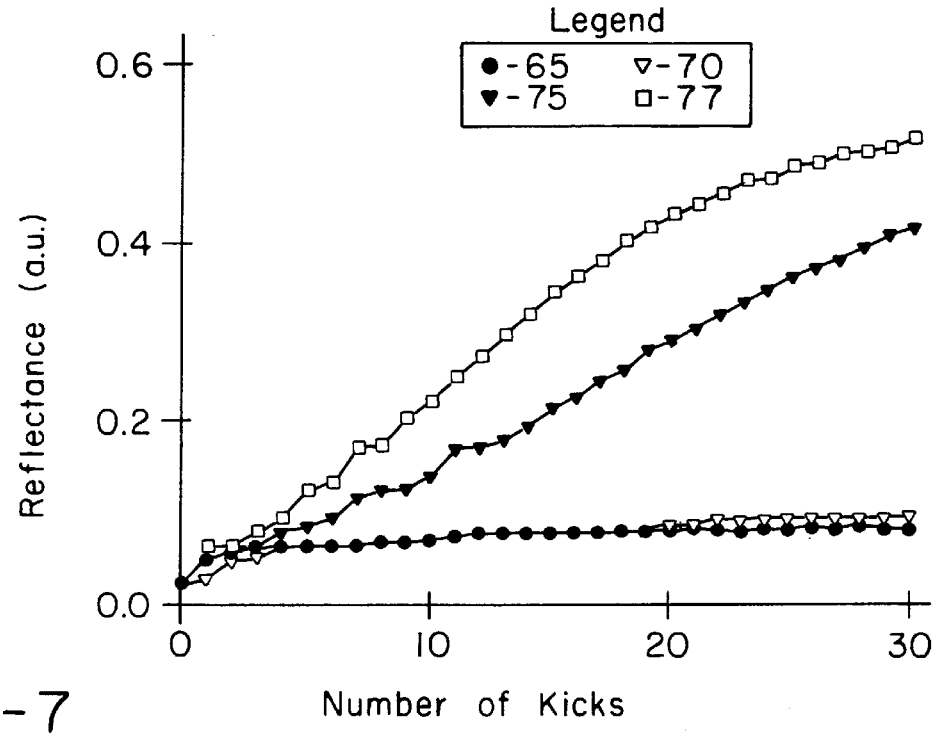
FIG. 7 is graphical representation of a liquid crystal material initially in a focal conic texture and the number of "kicks" required to adjust the reflectance thereof.

Referring now to FIG. 7 a graphical representation of how the drive scheme 34 may be utilized is shown. In particular, a preparation phase voltage $V_p$=45 volts is applied for a duration of 2 ms. Afterwards, a selection voltage is applied for 0.5 ms. In FIG. 7, the initial state is the focal conic texture as evidenced by the minimum reflectance value. In this example, when a selection voltage of 65 volts ($V_{low}$) is applied, the material remains in the focal conic texture. However, if a selection voltage of 77 volts ($V_{high}$) is applied, the material is driven or "kicked" to the planar texture in about 30 pulses.

Figure 8:
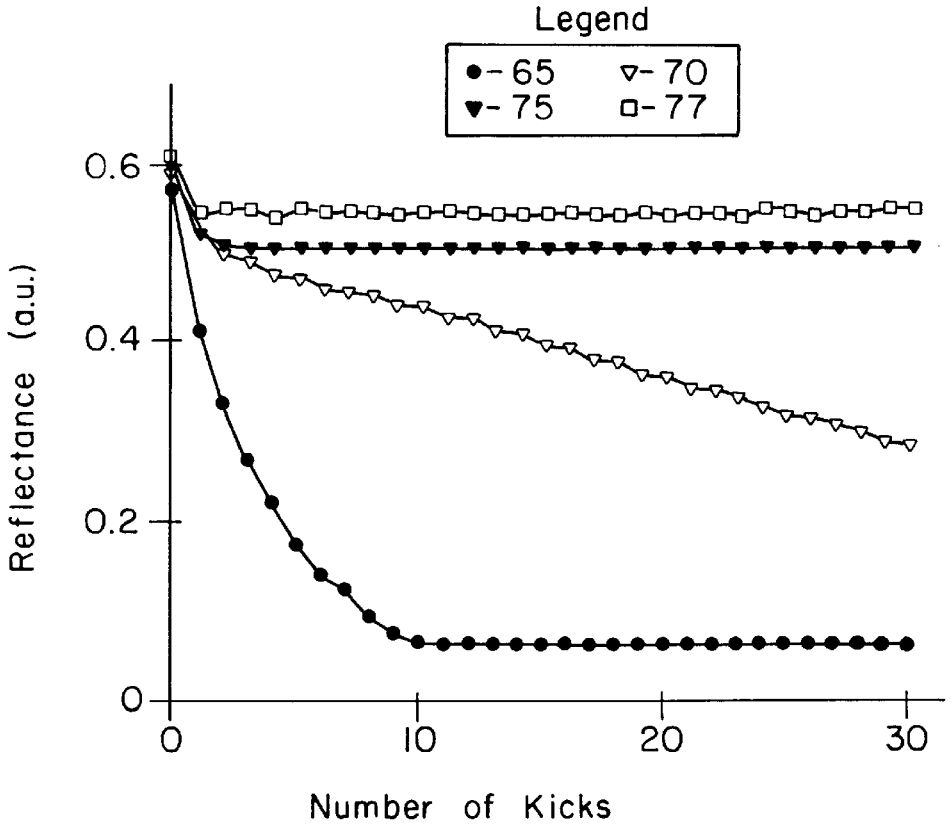
FIG. 8 is a graphical representation of a liquid crystal material initially in a planar texture and the number of "kicks" required to adjust the reflectance thereof.

In FIG. 8, the cholesteric material is initially placed in the planar texture as evidenced by the initial maximum reflectance. If the selection voltage is about 65 volts ($V_{low}$), the material is driven to the focal conic texture in about 10 pulses. However, if the selection voltage is about 77 volts ($V_{high}$), the cholesteric material remains in the planar texture. Regardless of whether the material is initially in the planar or focal conic texture, the number of pulses applied to the liquid crystal material may be limited to obtain a gray scale appearance.

For the displays discussed in FIGS. 7 and 8, if the updating frequency is about 20 Hz, the frame time is about 50 ms. Accordingly, the drive scheme 34 can address a cholesteric display of 100 lines with a single scan method, or 200 lines with a dual scan method. As those skilled in the art will appreciate, a dual scan method simultaneously addresses the top 100 lines and the bottom 100 lines of a 200 line display simultaneously.

Figure 9:
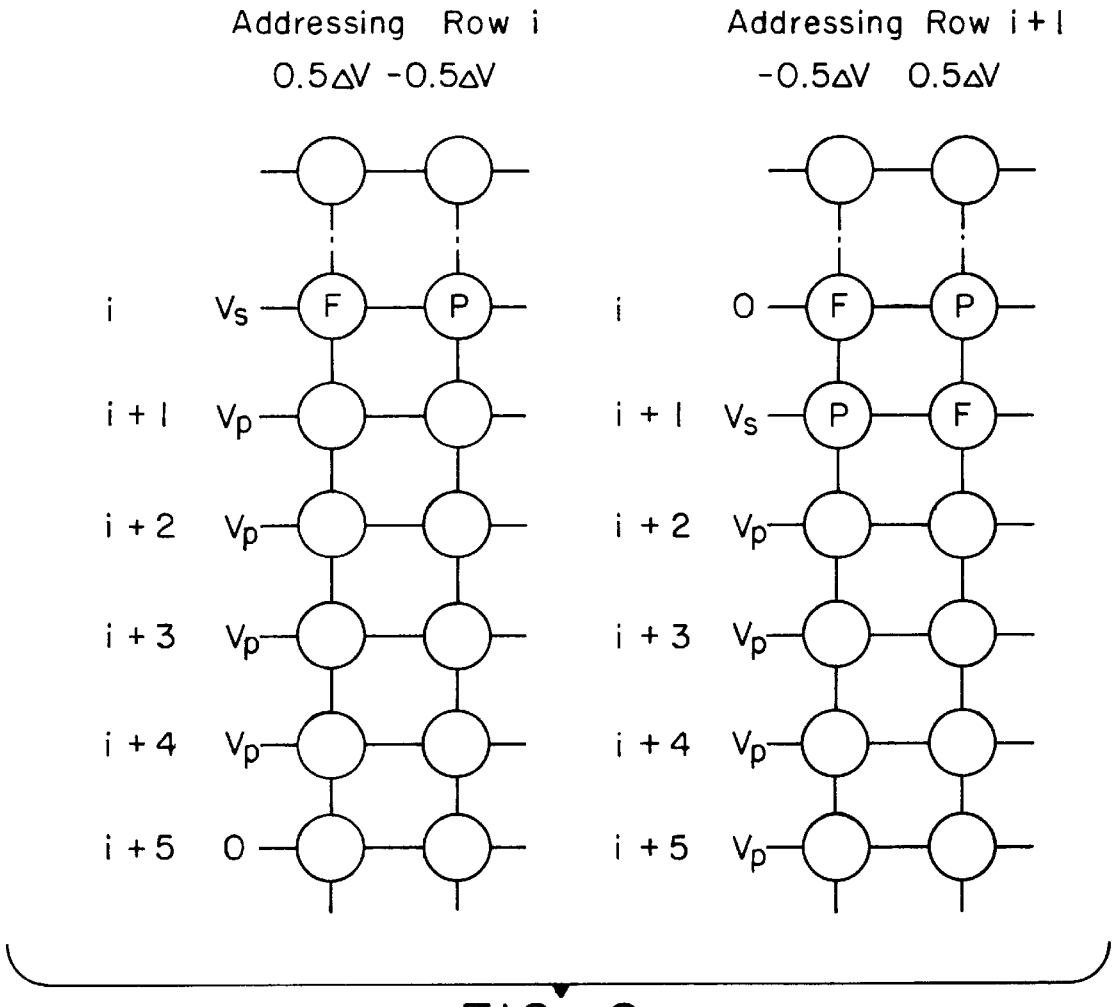
FIG. 9 is a schematic diagram showing an exemplary addressing sequence for the bistable cholesteric display.

The addressing sequence for the present invention is shown in FIG. 9. To efficiently address all of the lines of the display, a pipeline algorithm is used so that the preparation phase time is shared among the lines of the display. For the cells described above and discussed in FIGS. 7 and 8, four lines are in the preparation phase simultaneously. As will be appreciated, the number of lines that may be addressed is equal to or larger than the length of the preparation time divided by the selection time. During the preparation phase of the example, the row voltage is $V_P=(45^2-(0.5\Delta V)^2)^{1/2}=(45^2-6^2)^{1/2}=44.6V$. It will be understood that during the preparation and selection phases, the frequency of the applied row voltages is different. However, during the selection phase, the frequency of the applied column voltages are the same as the frequency of the applied row voltages. The row voltage for the selection phase is $V_{s\text{-}row}=(65+77)/2=71$ volts. The column voltage for the selection phase $V_{s\text{-}col}$ is either $0.5/\Delta V=(77-65)/2=6$ volts to address a pixel toward a focal conic texture or $-0.5\Delta V=(77-65)/2=-6$ volts to address a pixel toward the planar texture. Those skilled in the art will appreciate that the pixel voltage value is the difference between the row voltage applied and the column voltage applied. Therefore, during the selection phase 24, a selection row voltage value is determined that is the average of the $V_{high}$ and $V_{low}$. This allows use of a selection column voltage value that is half the difference between $V_{high}$ and $V_{low}$, wherein the polarity of the selection column voltage value is used to determine the texture of the liquid crystal material. If desired, the row and column voltage values could be transposed during the selection phase.

As seen in FIG. 9, the selection voltage applied to row i, where a positive $\Delta V$ value is applied to the leftmost column generates a focal conic texture as evidenced by the "F" designation and where a $-0.5\ \Delta V$ value is applied to the rightmost column a planar texture is generated as evidenced by the "P" designation. Accordingly, in the next row i+1 the leftmost column is provided with $-0.5\Delta V$ and planar texture appearance is generated and the rightmost column is provided with a $+0.5\Delta V$ value and a focal conic texture appearance is generated. Testing of this display cell with a 6 volt column voltage during the selection phase did not create any cross-talking problems.

Based upon the foregoing discussion of the drive scheme 34 several advantages are readily apparent. Primarily, each pulse of the scheme 34 is narrower than previously known two phase drive schemes because the pulse 20 does not have to drive the material completely from one texture to the other. Yet another advantage of the present invention is that the state of the material is changed incrementally by each pulse. As such, the flicker of the display is reduced which otherwise occurs when the material is driven completely by using a single non-cumulative application of voltage. Accordingly, this drive scheme is suitable for video rate operation of bistable cholesteric liquid crystal displays. Still a further advantage of the present invention is that the drive voltage may be reduced which allows for use of lower cost electronics and driving mechanisms.

Thus, it can be seen that the objects of the invention have been satisfied by the structure and use of the invention as presented above. While in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A method of addressing bistable chiral nematic liquid crystal material disposed between opposed substrates, wherein one of the substrates has a first plurality of electrodes facing a second plurality of electrodes on the other substrate, and wherein the intersection of the first and the second plurality of electrodes forms a plurality of pixels, and wherein the chiral nematic liquid crystal material may be driven to a focal conic texture having a low reflectance, a planar texture having a high reflectance or a combination of the focal conic and planar textures having a gray scale reflectance anywhere between the high and low reflectances, the method comprising the steps of:

a) applying a preparation voltage across the first and second plurality of electrodes with the liquid crystal material in either the focal conic texture, the planar texture, or a combination of the focal conic and planar textures to partially drive the liquid crystal material toward the focal conic texture;

b) subsequently applying a selection voltage across the first and second plurality of electrodes; and c) repeating steps a) and b) until the material exhibits a desired reflectance anywhere between and including the low reflectance and the high reflectance.

2. The method according to claim 1, further comprising the step of allowing the material to relax immediately after application of said selection voltage.

3. The method according to claim 2, wherein steps a) and b) drive the material toward an increasing level of reflectance if the material is presently in a focal conic texture and said selection voltage is at a high value.

4. The method acording to claim 2, wherein steps a) and b) drive the material toward a decreasing level of reflectance if the material is presently in a planar texture and said selection voltage is at a low value.

5. The method according to claim 2, wherein said step of subsequently applying said selection voltage comprises the step of:

choosing a selection voltage value sufficient to drive the material from one gray scale reflectance to another gray scale reflectance.

6. The method according claim 5, wherein said step of choosing comprises the steps of:

choosing a driving voltage value which causes the material to be incrementally diven from one gray scale reflectance to another gray scale reflectance; and choosing a holding voltage value which causes the material to remain in its initial reflectance.

7. The method according to claim 6, wherein said steps of choosing comprises the step of:

selecting said driving voltage value to be higher than said holding voltage value.

8. The method according to claim 6, wherein said steps of choosing comprises the step of:

selecting said driving voltage value to be lower than said holding voltage value.

9. A method of addressing a cell of bistable chiral nematic liquid crystal material disposed between opposed substrates, wherein one of the substrates has a plurality of row electrodes facing a plurality of column electrodes on the other substrate, wherein intersections of the row and the column electrodes form a plurality of pixels on the cell, and wherein the bistable chiral netmatic liquid crystal material may be driven to a focal conic texture having a low reflectance, a planar texture having a high reflectance or a combination of the focal conic and planar textures having a gray scale reflectance anywhere between the high and low reflectances, the method comprising the steps of:

applying a preparation voltage to one of said row electrodes and said column electrodes with the liquid crystal material in either the focal conic texture, the planar texture, or a combination of the focal conic and planar textures to partially drive the liquid crystal material toward the focal conic texture with some of the liquid crystal material remaining in the planar texture unless a complete focal conic texture is desired;

applying a portion of a selection voltage to one of said row electrodes and said column electrodes while applying a remaining portion of said selection voltage to the other of said row electrodes and said column electrodes;

allowing the material to relax for a predetermined period of time; and repeating said applying and said allowing steps until the material is driven to a desired reflectance anywhere between the low reflectance and the high reflectance, wherein the low reflectance is attributable to the material being exclusive in the focal conic texture, the high reflectance is attributable to the material being exclusively in the planar texture, and wherein the reflectance between the high and the low reflectance is attributable to a proportional combination of the focal conic and the planar textures.

10. The method according to claim 9, further comprising the steps of:

selecting a driving voltage value which causes the material to be incrementally driven from one texture to another;

selecting a holding voltage value which causes the material to remain in its initial texture;

assigning a row voltage value to said row electrodes which is about an average of said driving voltage value and said holding voltage value; and assigning a selected column voltage value to said column electrodes which is half the difference between said driving voltage value and said holding voltage value, wherein said selected column voltage is subtracted from said row voltage when said selection voltage is applied.

11. The method according to claim 10, wherein if the material is predominantly in a focal conic texture, the method further comprises the step of:

choosing a column voltage value to maintain the material in the focal conic texture.

12. The method according to claim 10, wherein if the material is predominantly in a focal conic texture, the method further comprises the step of:

choosing a column voltage value to partially drive the material toward a planar texture.

13. The method according to claim 10, wherein if the material is predominantly in a planar texture, the method further comprises the steps of:

choosing a column voltage value to partially drive the material toward a focal conic texture.

14. The method according to claim 10, wherein if the material is predominantly in a planar texture, the method further comprises the step of:

choosing a column voltage value to maintain the material in the planar texture.

15. The method according to claim 10, wherein said step of repeating is limited to a predetermined number of times to obtain a gray scale reflectance.

* * * * *

UNITED STATES PATENT AND TRADEMARK OFFICE

CERTIFICATE OF CORRECTION

PATENT NO. : 6,204,835 B1
DATED : March 20, 2001
INVENTOR(S) : Deng-Ke Yang and Yang-Ming Zhu It is certified that error appears in the above-identified patent and that said Letters Patent is hereby corrected as shown below:

Claim 6,
Line 4, delete the word "diven" and substitute therefor -- driven --.

Claim 9,
Line 32, delete the word "exclusive" and substitute therefor -- exclusively --.

Signed and Sealed this

Twenty-second Day of January, 2002

*Attest:*

*Attesting Officer*

JAMES E. ROGAN
*Director of the United States Patent and Trademark Office*